US006598592B2

(12) United States Patent
Scollard et al.

(10) Patent No.: US 6,598,592 B2
(45) Date of Patent: Jul. 29, 2003

(54) FUEL SYSTEM INCLUDING A FUEL INJECTOR INTERNALLY MOUNTED TO A FUEL RAIL

(75) Inventors: Joseph E. Scollard, Suffolk, VA (US); James R. Morris, Newport News, VA (US); Mehran K. Rahbar, Virginia Beach, VA (US)

(73) Assignee: Seimens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/969,143

(22) Filed: Oct. 3, 2001

(65) Prior Publication Data

US 2002/0038649 A1 Apr. 4, 2002

Related U.S. Application Data

(60) Provisional application No. 60/237,891, filed on Oct. 4, 2000.

(51) Int. Cl.[7] ..... F02M 55/02

(52) U.S. Cl. ..... 123/470; 123/456; 285/133.6; 239/600

(58) Field of Search ..... 123/469, 468, 123/470, 472, 456, 467; 285/133.11, 133.6, 133.5; 239/600, 585.1–585.5

(56) References Cited

U.S. PATENT DOCUMENTS

| | | | | |
|---|---|---|---|---|
| 4,457,280 A | | 7/1984 | Hudson et al. | 123/470 |
| 4,660,524 A | | 4/1987 | Bertsch et al. | 123/468 |
| 4,971,014 A | | 11/1990 | Usui | 123/470 |
| 5,018,499 A | | 5/1991 | Usui | 123/456 |
| 5,775,302 A | | 7/1998 | Guido et al. | 123/468 |
| 5,979,945 A | | 11/1999 | Hitachi et al. | 285/125.1 |
| 6,126,208 A | * | 10/2000 | Asada et al. | 285/133.4 |
| 6,321,719 B1 | * | 11/2001 | Schwegler | 123/467 |
| 6,374,809 B2 | * | 4/2002 | Satou | 123/470 |
| 6,431,151 B1 | | 8/2002 | Gmelin | 123/470 |

FOREIGN PATENT DOCUMENTS

| | | |
|---|---|---|
| EP | 2000320421 | 11/2000 |
| EP | 1 094 217 A2 | 4/2001 |
| JP | WO 98 15733 A | 4/1997 |
| JP | 10-205409 | 8/1998 |

* cited by examiner

*Primary Examiner*—Carl S. Miller

(57) ABSTRACT

A fuel system has a fuel injector directly mounted with a fuel rail. The fuel rail includes a first portion and a second portion that form a body. The body has an interior surface defining a volume, an exterior surface surrounding the interior surface, and at least one aperture disposed between the interior and exterior surfaces in fluid communication with the volume. The at least one fuel injector has an inlet tube with an inside surface defining a flow path through a portion of the fuel injector and an outside surface surrounding the inside surface. The fuel injector is disposed such that the flow path is in fluid communication with the volume. A rigid connection is disposed between the interior surface of the fuel rail and at least one of the outside surface and the inside surface of the inlet tube. The rigid connection secures and hermetically seals the fuel rail with the at least one fuel injector.

15 Claims, 2 Drawing Sheets

FUEL SYSTEM INCLUDING A FUEL INJECTOR INTERNALLY MOUNTED TO A FUEL RAIL

CLAIM FOR PRIORITY

This application claims priority to prior U.S. provisional application No. 60/237,891, entitled "Laser Welded Fuel Injectors Into Fuel Rail Assembly" filed Oct. 4, 2000, the disclosure of which is hereby incorporated by reference herein in its entirety.

FIELD OF THE INVENTION

The invention relates to a fuel system, and more particularly to a fuel system including a fuel injector rigidly connected with a fuel rail. The rigid connection secures and hermetically seals the fuel injector with the fuel rail, and therefore obviates the need for a clip to secure and an elastomeric member to seal the fuel injector with the fuel rail.

It is known to use a rail to deliver fuel to an injector in a conventional fuel delivery system. In the conventional system, an elastomeric member (for example, an O-ring), is disposed on the inlet of the injector. A separate cup that is brazed to the rail receives the injector inlet. By this arrangement, a hermetic seal is formed between the inlet having the elastomeric member and the cup. It is also known to use a clip to secure the injector to the rail and prevent separation.

However, the conventional system suffers from a number of disadvantages. The use of a clip to secure and an elastomeric member to seal the injector with the rail increases the cost and complexity of assembly. Further, it is believed that a more hermetically sealed flow path can be achieved through other assembly processes that eliminate the elastomeric member. For these reasons, it is desirable to provide a fuel system having a fuel injector that is rigidly connected to a fuel rail, the rigid connection securing and hermetically sealing without the use of a clip and an elastomeric member.

SUMMARY OF THE INVENTION

The present invention provides a fuel system having a fuel injector directly mounted with a fuel rail. The fuel rail includes a first portion and a second portion that form a body. The body has an interior surface defining a volume, an exterior surface surrounding the interior surface, and at least one aperture disposed between the interior and exterior surfaces in fluid communication with the volume. The at least one fuel injector has an inlet tube with an inside surface defining a flow path through a portion of the fuel injector and an outside surface surrounding the inside surface. The fuel injector is disposed such that the flow path is in fluid communication with the volume. A rigid connection is disposed between the interior surface of the fuel rail and at least one of the outside surface and the inside surface of the inlet tube. The rigid connection secures and hermetically seals the fuel rail with the at least one fuel injector.

The present invention also provides a method of forming a fuel system. The method includes providing at least one aperture in a fuel rail with a body having an interior surface to define a volume and an exterior surface surrounding the interior surface, the at least one aperture in fluid communication with the volume, and rigidly connecting an inlet tube of at least one fuel injector with the interior surface of the fuel rail to secure and hermetically seal the inlet tube of the fuel rail with the volume of the fuel injector.

BRIEF DESCRIPTIONS OF THE DRAWINGS

The accompanying drawings, which are incorporated herein and constitute part of this specification, illustrate presently preferred embodiments of the invention, and, together with the general description given above and the detailed description given below, serve to explain features of the invention.

DETAILED DESCRIPTION OF THE PREFERRED EMBODIMENT

Figure 1:
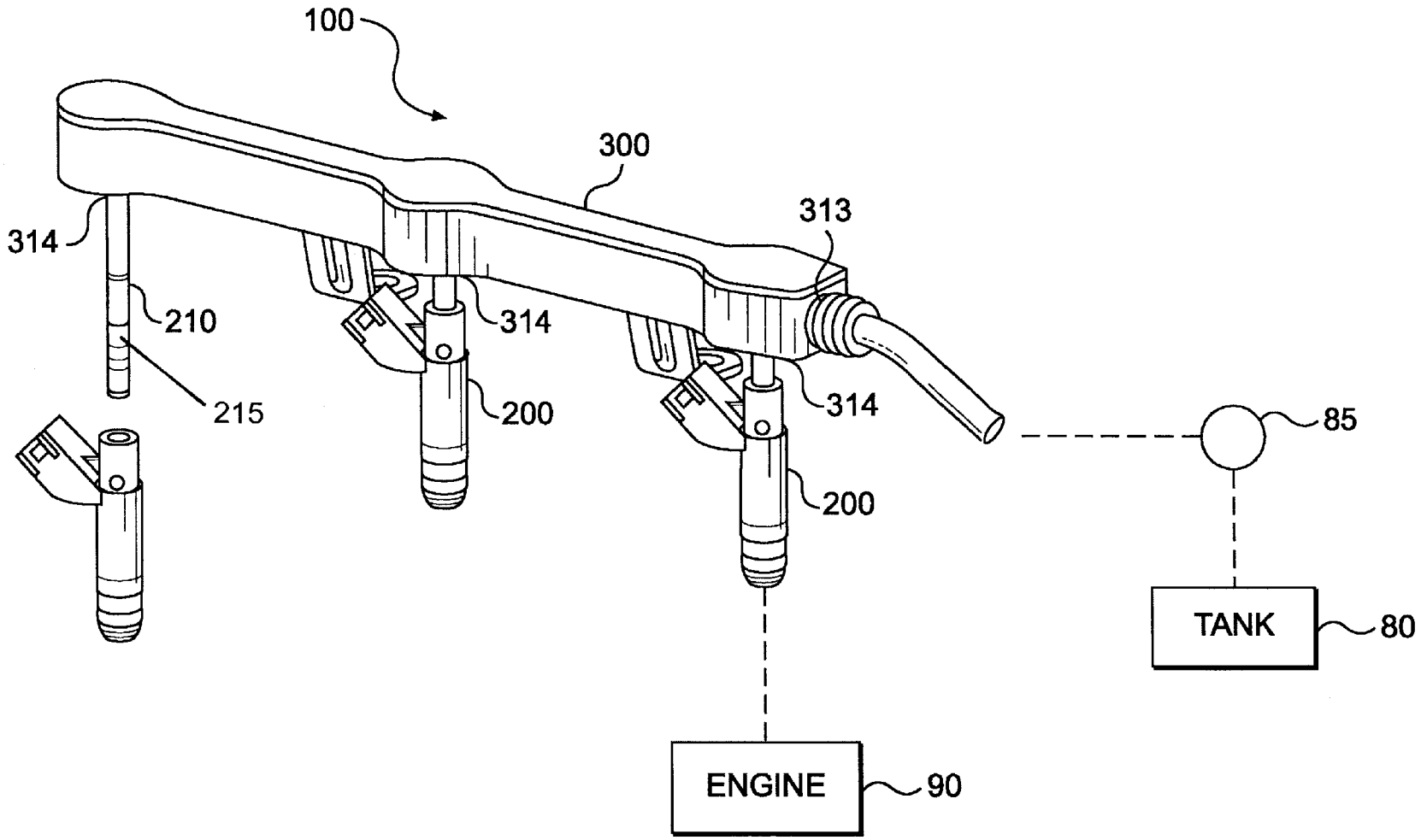
FIG. 1 shows a perspective representation of the fuel system having a fuel injector directly mounted to a fuel rail by a rigid connection.

FIG. 1 shows a preferred embodiment of a fuel system having a fuel injector rigidly connected to a fuel rail. The rigid connection secures and hermetically seals the fuel injector and the fuel rail, and, more preferably, secures and hermetically seals the fuel injector inlet tube and a surface of the fuel rail body. Although the figures show specific, preferred embodiments, it is to be understood that the fuel system can include any rigid connection that both secures and hermetically seals a fuel injector with a fuel rail. The hermetic seal prevents fuel leakage from between the fuel injector and the fuel rail during normal operating conditions of the fuel system. Preferably, the normal range of operation for the fuel system is about 35 psi to about 75 psi, and the hermetic seal has a burst pressure in excess of about 250 psi. The rigid connection obviates the need for a clip to secure and an elastomeric member to hermetically seal the fuel injector with the fuel rail. Hydrocarbon leakage within the fuel system of the preferred embodiment is believed to be greatly reduced as compared to the conventional system, because (1) any leakage that may occur between the rigidly connected fuel injector and the fuel rail should be much less than leakage past an elastomeric member between the injector and the rail of the conventional system, and (2) leakage through the elastomeric member itself is eliminated because the elastomeric member is not utilized.

The fuel system 100 includes a fuel injector 200 rigidly connected with a fuel rail 300. The fuel system 100 is installed in a motor vehicle, and, in a preferred embodiment, is installed in an automobile. Fuel stored in a tank 80 is delivered at pressure by a fuel pump 85 to an engine 90 by way of a fuel flow path from the fuel rail 300 to the fuel injector 200.

Figure 2:
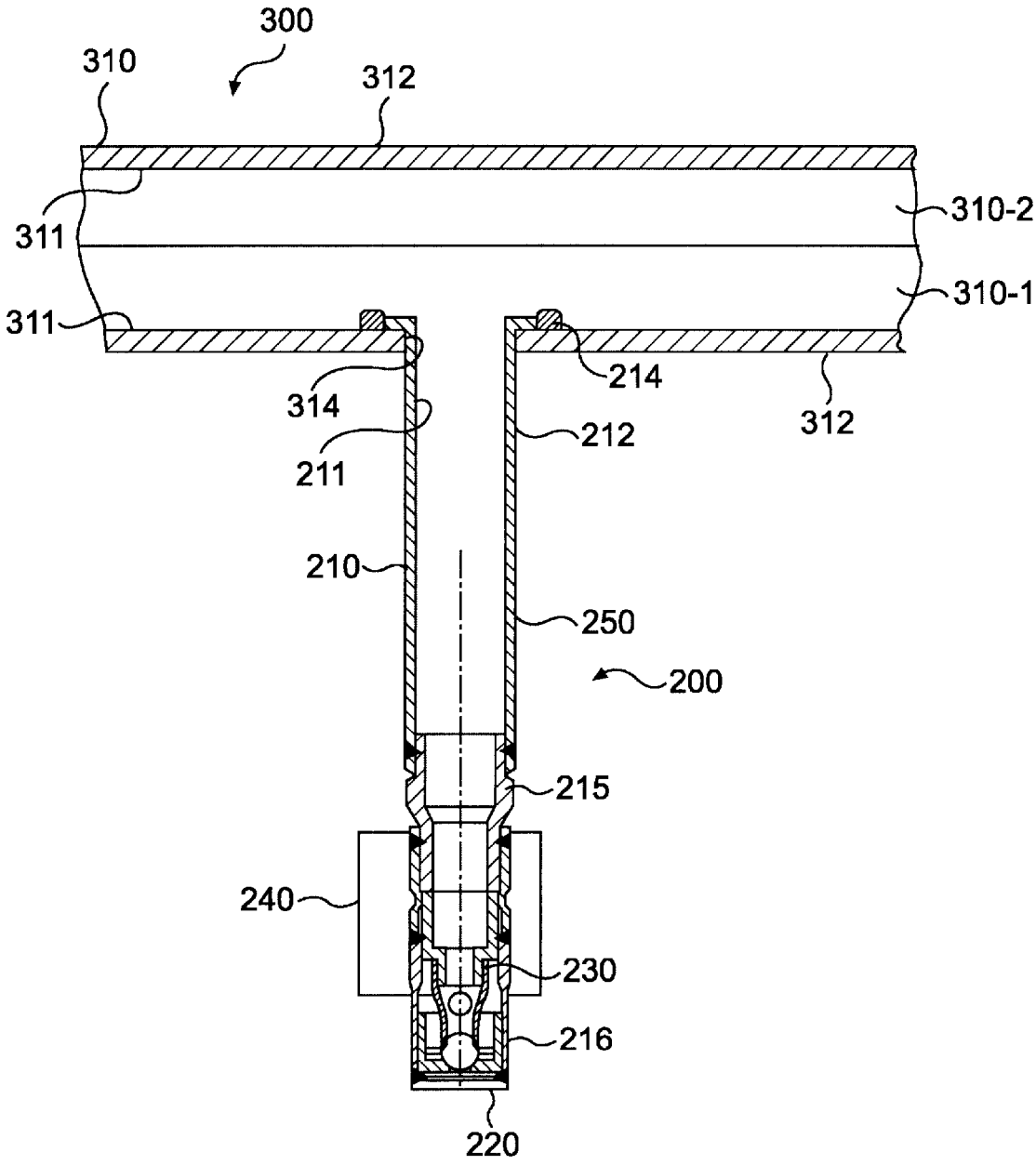
FIG. 2 shows a partial cross-sectional view of an embodiment of the rigid connection between a fuel injector and a fuel rail.

The fuel injector 200 is mounted to the fuel rail 300 with a rigid connection (to be discussed in detail). FIG. 1 shows a first preferred embodiment of fuel injector 200 that includes an outer cover surrounding a flow metering member that includes an electromagnetic actuator. FIG. 2 shows a second preferred embodiment of the fuel injector 200 having a particular valve metering arrangement. The fuel injector 200 includes an inlet tube 210 having an interior surface 211 to define a portion of the fuel flow path through the injector 200, and an exterior surface 212 that surrounds and is coaxial with the interior surface 211. The exterior surface 212 includes a protrusion 214 that encircles an entire perimeter of a terminal end of the inlet tube 210. In the preferred embodiments shown in the figures, the exterior surface 212 and the protrusion 214 of the inlet tube 210 are rigidly connected with the fuel rail 300. However, it is to be understood that any portion of the inlet tube 210, and any other portion of the fuel injector 200, can be connected with the fuel rail 300, so long as the connection secures and hermetically seals the fuel injector 200 with the fuel rail 300.

In the preferred embodiment shown in the drawings, the fuel injector 200 includes a tube assembly 250 is formed by the inlet tube 210, a pole piece 215, a sleeve 216, and the aperture 220. A valve assembly 230 including an armature positionable to permit and prohibit fluid flow through the aperture 220 is disposed entirely within the tube assembly 250. An actuator assembly 240 cinctures the tube assembly 250 such that electromagnetic signals position the valve assembly 230 to open and close the fuel injector 200 in response thereto. Thus, formation of the rigid connection can be made between the fuel rail 300 and the tube assembly 250 including the valve assembly 230, such that completion of the fuel injector 200 can be achieved by disposing the actuator assembly 240 on the rigidly connected tube assembly 250. Although not shown, the actuator assembly 240 can be surrounded by a cover to provide for electrical connection with a socket.

Although the figures show examples of the tube assembly 250 extending an entire length of the fuel injector 200 and containing the valve assembly 230, it should be understood that the tube assembly 250 need only provide a portion of the flow path through the fuel injector 200, and need not house and retain the valve assembly 230.

The fuel rail 300 is rigidly connected with the fuel injector 200. The fuel rail 300 includes a body 310 having an interior surface 311 to define a portion of the fuel flow path and an exterior surface 312 surrounding and coaxial with the interior surface 311. In the preferred embodiment shown in the drawings, the body 310 is formed by a housing 310-1 and a cover 310-2 hermetically connected with each other. Preferably, the body 310 is manufactured by the assembly of stamped elements, and hermetically connected via a weld, and, more preferably, by laser welding. The body 310 defines an inlet 313 and an aperture 314 in fluid communication with the volume. Preferably, the aperture 314 is disposed through the housing 310-1. However, it is to be understood that the aperture 314 can be disposed through any portion of the body 310, so long as the aperture 314 is in fluid communication with the volume.

As discussed above, the rigid connection seals and hermetically secures the fuel injector 200 with at least one of the interior and exterior surfaces of the fuel rail 300, and, in a more preferred embodiment, seals the inlet tube 210 with the interior surface 311. The rigid connection seals and hermetically secures the fuel injector 200 with the fuel rail 300 without the use of additional clip and elastomeric members. Preferably, the rigid connection is formed by a weld, and, in a more preferred embodiment, is formed by laser welding. As shown in the embodiment of FIG. 2, the rigid connection secures and hermetically seals the exterior 212 and protrusion 214 of the inlet tube 210 with the interior surface 311 of the housing 310-1.

The fuel system 100 of FIG. 2 is preferably assembled as follows. The tube assembly 250 including the valve assembly 230 of the fuel injector 200 is inserted through the aperture 314 in the housing 310-1. The tube assembly 250 is urged in a direction away from the volume, until the protrusion 214 of the inlet tube 210 rests against the interior surface 311. The rigid connection is formed between the exterior 212 and the protrusion 214 of the inlet tube 210 and the interior surface 311 of the housing 310-1, such that the fuel injector 200 is secured and hermetically sealed with the fuel rail 300. Assembly of the fuel injector 200 is completed by the disposition of the actuator assembly 240 on the tube assembly 250.

In a preferred embodiment, the fuel rail 300 extends along a substantially straight axis, the fuel rail including a multiplicity of fuel injectors 200 rigidly connecting with a plurality of apertures 314. The fuel rail 300 can also include a plurality (at least 2) parallel rails fluidly connected via a connecting tube. The fuel injectors 200 can be equally spaced along the parallel axes of the parallel rails, and rigidly connected thereto.

While the present invention has been disclosed with reference to certain preferred embodiments, numerous modifications, alterations, and changes to the described embodiments are possible without departing from the sphere and scope of the present invention, as defined in the appended claims. Accordingly, it is intended that the present invention not be limited to the described embodiments, but that it will have the full scope defined by the language of the following claims, and equivalents thereof.

What is claimed is:

1. A fuel system comprising:

a fuel rail including a first portion and a second portion forming a body, the body having an interior surface defining a volume, an exterior surface surrounding the interior surface, and at least one aperture disposed between the interior and exterior surfaces in fluid communication with the volume;

at least one fuel injector haying an inlet tube assembly containing a valve assembly and an inlet tube, the inlet tube including an inside surface defining a flow path through a portion of the fuel injector and an outside surface surrounding the inside surface, the flow path in fluid communication with the volume; and a rigid connection between the interior surface of the fuel rail contiguous to at least one of the outside surface and the inside surface of the inlet tube that secures and hermetically seals the fuel rail with the at least one fuel injector.

2. The fuel system according to claim 1, wherein the first portion comprises a housing and the second portion comprises a cover, the housing and the cover hermetically sealed with one another, and the aperture disposed through the housing.

3. The fuel system according to claim 2, wherein the housing and the cover are hermetically sealed via a weld.

4. The fuel system according to claim 3, wherein the weld is formed by laser welding.

5. The fuel system according to claim 4, wherein the housing and cover are formed by stamping.

6. The fuel system according to claim 1, wherein the rigid connection is formed by welding.

7. The fuel system according to claim 1, wherein the at least one aperture comprises a multiplicity of apertures, and the at least one fuel injector comprises a multiplicity of fuel injectors.

8. A method of forming a fuel system, comprising:

providing at least one fuel injector having an inlet tube assembly containing a valve assembly with an inlet tube, and at least one aperture in a fuel rail with a body having an interior surface to define a volume and an exterior surface surrounding the interior surface, the at least one aperture in fluid communication with the volume; and rigidly connecting an inlet tube contiguous to the interior surface of the fuel rail to secure and hermetically seal the inlet tube to the fuel rail and with the volume of the fuel rail.

9. The method according to claim 8, further comprising:

hermetically securing a housing with a cover to form the body.

10. The method according to claim 9, further comprising:

forming the housing and the cover by a process of stamping.

11. The method according to claim 9, wherein hermetically securing comprises hermetically securing via a weld.

12. The method according to claim 9, wherein providing the at least one aperture comprises providing the at least one aperture in the housing.

13. The method according to claim 12, wherein rigidly connecting comprises rigidly connecting via welding.

14. The method according to claim 8, wherein providing the at least one aperture comprises providing a plurality of apertures.

15. The method according to claim 14, wherein rigidly connecting the inlet tube of the at least one fuel injector comprises rigidly connecting the inlet tubes of a plurality of fuel injectors.

* * * * *